United States Patent [19]

Schwab et al.

[11] 4,402,627

[45] Sep. 6, 1983

[54] RUNNER TO KEEP OFF SNOWPLOWS

[75] Inventors: Kurt Schwab, Mils; Gerhard Unterberger, Fritzens, both of Austria

[73] Assignee: D. Swarovski & Co., Wattens, Austria

[21] Appl. No.: 364,896

[22] Filed: Apr. 2, 1982

[30] Foreign Application Priority Data

Apr. 15, 1981 [DE] Fed. Rep. of Germany ..... 3115300

[51] Int. Cl.[3] ..... E01F 9/06

[52] U.S. Cl. ..... 404/15

[58] Field of Search ..... 404/6, 15, 16, 9

[56] References Cited

U.S. PATENT DOCUMENTS

| | | | |
|---|---|---|---|
| 1,927,756 | 9/1933 | Ross | 404/16 |
| 1,927,757 | 9/1933 | Ross et al. | 404/16 |
| 1,952,942 | 3/1934 | Ross | 404/16 |
| 2,337,793 | 12/1943 | Abbott | 404/16 |
| 2,371,462 | 3/1945 | Nicholson | 404/15 |
| 2,699,982 | 1/1955 | Batterson | 404/15 |
| 3,587,416 | 6/1971 | Flanagan | 404/9 |
| 3,790,293 | 2/1974 | Heenan et al. | 404/15 |
| 3,809,487 | 5/1974 | Flanagan | 404/15 |
| 3,975,108 | 8/1976 | Suhr et al. | 404/16 |
| 3,980,410 | 9/1976 | Suhr et al. | 404/16 |
| 4,147,447 | 4/1979 | Heenan et al. | 404/16 |
| 4,195,945 | 4/1980 | Heenan | 404/16 |

FOREIGN PATENT DOCUMENTS

| | | | |
|---|---|---|---|
| 650674 | 2/1951 | United Kingdom | 404/9 |
| 670107 | 4/1952 | United Kingdom | 404/16 |

*Primary Examiner*—Nile C. Byers, Jr.
*Assistant Examiner*—Beverly E. Hjorth
*Attorney, Agent, or Firm*—Bacon & Thomas

[57] ABSTRACT

A runner to keep snowplows off of a pavement or surface area for the protection of ground markings, comprising an upper portion 12 having a base 1 to be placed on the street surface 21 and upward sloping surfaces 2 and sloping sides 3 and an anchoring portion 5 to be inserted into a corresponding recess in the pavement 20, whereby the longitudinal side walls 6 of the anchoring portion 5 are perpendicular to the base 1 and extend longitudinally beyond the base 1 and the upward sloping surfaces 2 extend below the base 1.

10 Claims, 3 Drawing Figures

RUNNER TO KEEP OFF SNOWPLOWS

Figure 1:
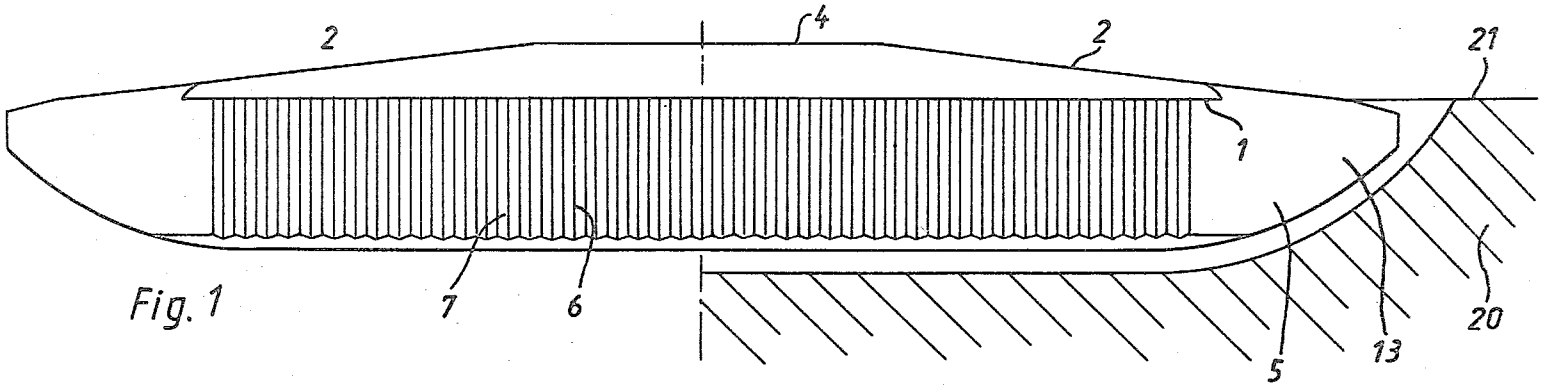

The invention relates to a runner or runner-shaped protective element to keep off snowplows for the protection of ground markings and similar devices, in particular traffic studs, against snowplows going over them.

Sevral proposals for protecting ground markings from snowplows have become known. Ground markings protected against snowplows are necessary in areas with frequent snowfall where the streets are cleared by snowplows, since the markings are otherwise torn off or damaged.

German Auslegeschrifts Nos. 17 84 198 and 20 36 675 and German Offenlegungsschrift No. 27 19 879 describe street markings protected against snowplows, having at least two protrusions to be inserted into a corresponding recess in the street surface in order to anchor the street markings in the street so that they are safe from snowplows.

However, the known street markings involve a number of disadvantages. First of all, the known street markings are difficult to manufacture, especially their shaping. Secondly, special complicated machines are necessary to provide the recesses in the street surface required for the insertion of the street markings. Thirdly, the known street markings are not applicable in a wide variety of cases, as they only protect the marking devices integrally connected with them. Fourthly, the known street markings are too elaborate and thus too expensive for many types of application, since in order to mark the side of the road, for example, it suffices to protect just one side of the markings, as a snowplow only approaches on one side.

The invention is thus based on the problem of providing a device that is easy to manufacture and easy to install for reliable protection of ground markings, in particular traffic studs, against snowplows.

The invention is based on the finding that this problem can be solved by a runner to keep off snowplows which is attached on the street in the vicinity of the ground marking, but is not connected with it.

The subject-matter of the invention is a runner to keep snowplows off a pavement or surface area characterized in that it comprises an upper portion having a base that can be placed on the street surface and upward sloping surfaces and sloping slides and an anchoring portion to be inserted into a corresponding recess in the street surface, whereby the longitudinal side walls of the anchoring portion are perpendicular to the base and extend longitudinally beyond the base surface and the upward sloping surfaces extend below the base.

The upper portion has a longitudinally extending central portion with a lower base surface for engaging the pavement. The central portion includes upper, longitudinally and downwardly sloping end surfaces which extend from opposite upper longitudinal end areas of the central portion. The sloping sides extend laterally and downwardly from opposite lateral sides of the central portion. The anchor portion is of less width than the central portion and depends vertically from a central area of the central portion. The anchor portion includes upper, longitudinally and downwardly sloping end surfaces which project beyond the sloping end surfaces of the central portion and form longitudinal continuations of the central portion sloping end surfaces.

The runners to keep off snowplows according to the invention are optimally suited to protecting all kinds of ground markings and similar devices and especially to protecting traffic studs. Protection from snowplows is of great importance for permanent markings, lane divisions and pedestrian crossings.

The runners can be manufactured easily in a two-piece form.

It is also possible to mount the runners on the street with simple means. It is merely necessary to form a slot in the street surface, for example with an appropriate disk type milling cutter. The slot must be slightly longer and wider than the anchoring portion of the runner that is to be inserted. The runner is then stuck to the street surface with an appropriate adhesive. It may be advantageous to level the street surface when applying the slot in order to ensure that the base of the runner lies flat and is thus arranged accurately on the street and adheres well to the street surface.

The runners are placed in the vicinity of the ground marking in such a way that the shovel of the snowplow that is raised by the runner can no longer touch the ground marking.

The runners are particularly well suited to protecting ground markings at the side of the street. As a snowplow can only approach the ground markings on one side, i.e. on the street side, the latter are completely and easily protected from the snowplow by runners according to the invention arranged on the street side. It is also advantageous that no pockets of dirt form around the ground markings as the runners can be arranged at a distance from the markings.

The runners according to the invention can be used to protect in a simple way all types of ground markings and other devices provided on the street surface. The runners are thus applicable flexibly and in many different ways.

The longitudinal side walls preferably exhibit a plurality of ribs which can particularly be arranged perpendicular to the base.

It is already known from the above-mentioned publications to form the underside of the portion extending into the street surface in tiers. However, such a formation does not offer sufficient anchoring safety and thus involves the risk that the ground marking be torn out by the snowplow.

Firm anchorage is ensured, however, by a rib formation. The ribbing allows for a considerable enlargement in the surface of the longitudinal side walls, on the one hand, thus greatly improving the connection with the street surface by means of an adhesive. The runner is also particularly well protected against being tipped out due to its rough ribbed surface. In particular, the ribbing avoids displacement of the runner parallel to the street. Finally, the adhesive slides up well between the ribs when the runner is being inserted into the slot in the street, so that only small amounts of adhesive are required, on the one hand, and an adhesive connection is ensured across the entire surface, on the other.

In the following, the invention is described in more detail on the basis of an embodiment shown in the drawings. These show:

FIG. 1 a side view

Figure 2:
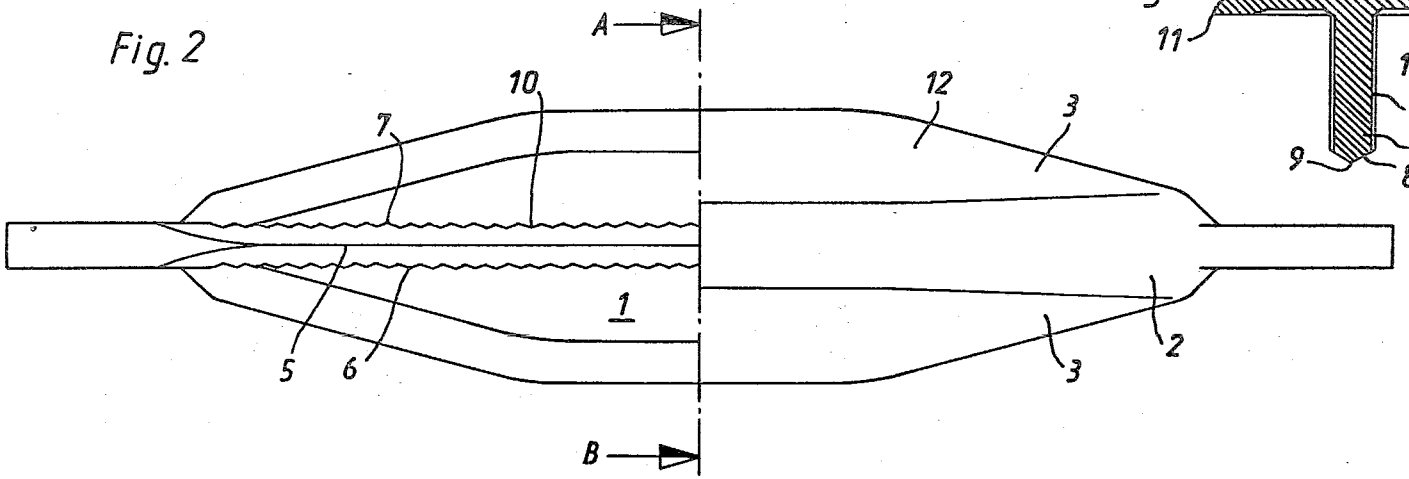

FIG. 2 a top view partly showing the front and partly the back

Figure 3:
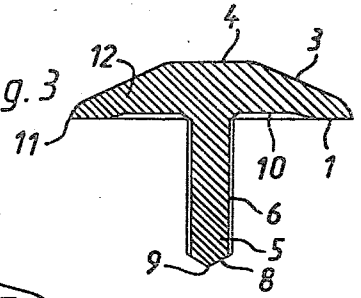

FIG. 3 a section along line A—B of FIG. 2

The runner comprises an upper portion 12 and an anchoring portion 5 integrally connected with it. The upper portion is limited by a base 1 which is flat and is placed on the street surface 21, as well as upward sloping surfaces 2 and sloping sides 3. A level surface 4 parallel to base 1 can be provided in order to facilitate being driven over.

The upper portion of the runner grows narrower towards the ends. An angle between 10° and 25°, in particular 15°, is preferably maintained herein. In the area of the ends the angle is preferable steeper, i.e. around 45°.

In the preferred embodiment shown, the base measures 240 mm longitudinally and 64 mm at the widest place crosswise. The level surface measures approximately 80 mm longitudinally and 20 mm crosswise.

The entire height of the runner above the street surface, i.e. the distance between base 1 and surface 4, can be selected according to the case at hand and usually ranges between 10 and 25 mm, particularly between 10 and 15 mm.

In order to ensure that the runners can be easily and safely driven over it is essential that the upward sloping surfaces 2 as well as the sloping sides 3 be at relatively small angles to the horizontal. The angles of the upward sloping surfaces preferably range between 4° and 15°, particularly 7°. The angles of the sloping sides preferably range between 10° and 35°, particularly 25°. The sloping sides 3 are preferably rounded off towards the street surface at their lower end.

Base 1 can have ribs or depressions 10 to take up adhesive in order to ensure better adhesion to the street surface.

The long anchoring portion extends beyond both sides of the upper portion 72. In the embodiment shown, the entire length is 320 mm, the height of the anchoring portion 5 is 35 mm and its width is 10 mm. The underside 8 of the anchoring portion preferably ends in edge 9 in order to facilitate insertion in the street 21. Ends 13 of the anchoring portion are preferably curved downward convexly so that the runner can be easily inserted into a slot formed in the street 21 by means of a disk type milling cutter. The outmost ends of anchoring portion 5 preferably flatten out.

In the runners according to the invention it is essential that the upward sloping surfaces 2 extend down to just below base 1. This ensures that when base 1 is seated on the street surface, end 13 of the anchoring portion comes to lie below the surface 20 of the street 21 and thus guarantees that snowplows as well as car tires do not hit the end, but rather the sloping surface 2. Sloping surfaces 2 preferably extend 1–10 mm, particularly 2 mm, under the base.

The edges of the runner according to the invention are preferably rounded off everywhere.

Vertical ribs 7 on longitudinal side wall 6 can be of varying design, but an interval of approximately 5 mm between the ribs is preferred at an angle of recess of 150°.

It may also be considered to provide other types of recesses and notches, such as recesses 1 mm deep or bores across and through the longitudinal side wall, in longitudinal side wall 6 instead of ribs. These kinds of formations for the anchoring portion may also contribute to firmer support of the runner in the street.

Preferably those surfaces of the runner that come in contact with car tires, i.e. upward sloping surfaces 2, sloping sides 3 and surface 4, are designed so as to be rought, which can be achieved, for example, by appropriate grooving, honeycombing or raised portions and recesses.

The runner to keep off snowplows according to the invention is preferably made of metal. It can be produced by casting. However, the runner may also be made of impact resistant plastic or other materials.

We claim:

1. A runner to keep snowplows off a pavement or surface area, the runner comprising:

a longitudinally extending upper central portion having a lower base surface for engaging the pavement, the central portion including upper, longitudinally and downwardly sloping end surfaces extending from opposite upper longitudinal ends of said central portion; and laterally extending downwardly sloping side surfaces extending from opposite lateral sides of said central portion; and a central, longitudinally extending anchor portion of less width than said central portion and depending vertically from a central area of said central portion below said base surface, said anchor portion including upper longitudinally and downwardly sloping end surfaces projecting beyond said sloping end surfaces of said central portion, and in effect forming longitudinal continuations of said central portion sloping end surfaces.

2. A runner according to claim 1, wherein said upper central portion includes a central generally planar surface extending parallel to said base surface and located between said sloping end surfaces.

3. A runner according to claim 1 or 2, wherein said sloping side surfaces of said central portion are inclined between 10° and 35° from the horizontal.

4. A runner according to claim 3, wherein said sloping end surfaces of said central portion are inclined between 4° and 15° from the horizontal.

5. A runner according to claim 4, wherein said base surface is recessed to receive an adhesive.

6. A runner according to claim 1, wherein said anchor portion includes vertically ribbed opposed sidewalls extending vertically from said base surface.

7. A runner according to claim 1, said anchoring portion including bottom, longitudinally extending, inwardly tapered surfaces meeting along a central longitudinal edge.

8. A runner according to claim 1, wherein the plane including said base surface projects above the end areas of the end surfaces of said anchor portion by 1–10 mm.

9. A runner according to claim 1, wherein said anchor portion includes a bottom surface including convexly curved bottom end surface portions.

10. A runner according to claim 2, wherein said sloping end and side surfaces, and said planar surface, are roughened.

* * * * *